US006073796A

United States Patent [19]

Mogil

[11] Patent Number: 6,073,796

[45] Date of Patent: Jun. 13, 2000

[54] INSULATED BOTTLE STRUCTURE

[75] Inventor: Melvin S. Mogil, Toronto, Canada

[73] Assignee: California Innovations Inc., Ontario, Canada

[21] Appl. No.: 09/122,098

[22] Filed: Jul. 24, 1998

[30] Foreign Application Priority Data

Jul. 23, 1998 [CA] Canada ..... 2243917

[51] Int. Cl.[7] ..... B65D 25/34

[52] U.S. Cl. ..... 220/592.17; 220/903; 220/739; 220/592.24; 215/12.1; 224/148.6

[58] Field of Search ..... 220/903, 739, 220/737, 592.16, 592.17, 592.24; 224/148.3, 148.4, 148.5, 148.6; 215/12.1

[56] References Cited

U.S. PATENT DOCUMENTS

D. 335,957 6/1993 Cantrell et al. ..... D3/303
3,282,068 11/1966 Cain ..... 220/903
4,197,890 4/1980 Simko ..... 383/97
5,467,891 11/1995 Perry ..... 220/739
5,680,958 10/1997 Mann et al. ..... 220/739
5,915,580 6/1999 Melk ..... 220/903

*Primary Examiner*—Stephen Castellano
*Attorney, Agent, or Firm*—Arent Fox Kintner Plotkin & Kahn, PLLC

[57] ABSTRACT

An insulated container has an internal, removal bottle that can be filled with a chosen liquid. It can be placed in a removable insulation covering to increase the time to lose its chill, or warmth, as the case may be. The insulation cover can be squeezed with the bottle to yield a stream of liquid so that the bottle need not touch a users mouth. The cover has a pocket for small objects. The closure of the cover is inclined relative to the bottle, and has an opposed handle. The interaction of the handle location and inclined closure yields a pleasing action the pocket is eased at one side preferentially to accommodate objects along that side.

23 Claims, 6 Drawing Sheets

INSULATED BOTTLE STRUCTURE

FIELD OF INVENTION

This invention relates generally to portable liquid refreshment containers and accessories for such containers. In particular it relates to squeezable, refreshment containers that have removable insulation coverings.

BACKGROUND OF THE INVENTION

Portable refreshment bottles have been used for many years by cyclists, hikers, and others. During a lengthy activity the contents of the refreshment container may no longer be at the desired temperature. That is, a bottle that may have been chilled at the start of the day, may have warmed to ambient by the time the refreshment is required. Conversely, it a warmed liquid is desired, by the time the container is opened the liquid may only be lukewarm or tepid. One method of dealing with this has been to fill a refreshment container long enough beforehand to permit the contents to be frozen. Then the contents melt during the day, and retain at least some cooling effect far longer than they might otherwise have done. In the case of hot drinks, and cold drinks, another approach has been to use a glass bottle within a metal or rigid bottle, with an airspace between the inner and outer containers. While these containers maintain the hot temperature of the liquid well, they tend to be cumbersome. It would be advantageous to have a refreshment bottle that has a softer exterior than the rigid type of heat-retaining container, and yet be better insulated than merely a thin walled plastic bottle.

Another concern in recent times has related to transmission of disease by the common use of water bottles. One way around this problem is to provide a bottle with a nozzle that permits the liquid, typically water, to be squeezed out in a stream, such that the container need not touch anyone. Of course, it is difficult to squeeze a rigid insulated bottle. Again, it would be advantageous to have an insulated bottle that can be squeezed without the bottle actually touching the mouth of the person using it. To this end an insulation layer that can be squeezed at the same time as the bottle is desirable.

A disadvantage of traditional rigid insulated bottles is that it is highly inefficient to place them in the refrigerator or the freezer to freeze their contents. It would be more effective to be able to remove the inner container from the insulation layer, so that its contents can be relatively efficiently chilled or frozen, and then to replace the inner bottle within the insulation layer when the cooling operation has been completed. Further, for warm or sticky liquids the inner bottle can be washed and dried after filling, and before placement within the insulating layer. The removal of the bottle from the insulation layer also provides an opportunity for the insulation layer to be cleaned and dried if it has previously become soiled or sticky. it is also helpful for the insulation layer to have a collar for fitting about the neck or spout of the bottle, first to permit the bottle to be emptied without having to be removed from the insulation, and second to permit the bottle to be refilled with the insulation layer in place, if need be. A closure that can ease the collar, and thereby permit the bottle to be removed is also helpful, and it to be preferred over a removable lid that cam become detached and lost.

For a cyclist, or cross country skier, for example, it may be uncomfortable to travel with a large number of objects in one pant's pocket or another. In some instances the sportswear chosen is of a kind lacking pockets. Yet, having driven to a skiing or cycling location, a convenient place for keys, or other objects, may be desired. To that end it would be helpful to have a refreshment container that can be attached to the bicycle, or that can be slung about the body, that has a compartment, pocket, or pouch for containing such objects.

Placement of a pocket on a round, cylindrical surface poses some challenges. One is that, when a closure, such as a zipper, is drawn closed, the flexible panel to which it is attached, (that is, the body of the pocket), will tend to be drawn taut to the cylindrical shape. This may not yield a sufficiently capacious pocket, or may place undesirable stresses on the insulating layer, or cover material generally. However, one portion of the pocket, or pouch, such as a side or edge, can be eased by providing a collapsible or foldable gusset or tuck, or pleat. When the zipper or closure is drawn closed it will force one end of the gusset to be drawn tight, but the remainder will allow larger objects located to nestle preferentially along that side or edge. A somewhat elastic or flexible main pocket panel will enhance the usefulness of the pocket.

In an asymmetric pocket of this type, the part of the pocket furthest from the tuck or pleat, will still tend to be drawn in closely o the contour of the round cylindrical surface. As such it may not require the same breadth (or height, as the case may be) of the opposed side. Further, it has been observed that a sliding closure, such as a zipper, opens and closes with a pleasing feel when the line of action is inclined somewhat with respect to the longitudinal axis of the container. For a nominally straight sliding closure, the path as the closure follows the generally cylindrical surface will, if inclined, follow a helical arc. This pleasing action is enhanced when a handle, such as a relatively tight strap is placed on the opposite side of the container from the pocket, the handle is held with the fingers of one hand, and the zipper car is held with the fingers of the other hand.

SUMMARY OF THE INVENTION

In an aspect of the invention there is a pouch for a cover of a hand held liquid container. The pouch has a periphery for mounting to the cover and a closure for controlling access to the interior of the pouch.

In another aspect of the invention there is a pouch for a cover of a hand held refreshment container having a longitudinal axis and a curved surface extending thereabout. The pouch comprises a periphery for mounting to the cover and a closure for controlling access to the interior of the pouch. The closure extends in a direction having a component parallel to the axis and another component skewed relative to the axis.

In an additional feature of that aspect of the invention the closure includes a guide for following the cover next to the curved surface. In another additional feature of that aspect of the invention the periphery includes an expandable portion adjacent to the closure. In still another additional feature of that aspect of the invention the expandable portion includes a foldable member. In yet another additional feature of that aspect of the invention the expandable portion is an edge running parallel to the longitudinal axis and the foldable member is a pleated gusset. In a further additional feature of that aspect of the invention the closure is inclined relative to the longitudinal axis. In a still further additional feature of that aspect of the invention the closure follows a helical arc relative to the longitudinal axis. In yet another additional feature of that aspect of the invention the closure forms a portion of the periphery of the pouch. In still yet another additional feature of that aspect of the invention the closure is of an interlocking closure. In another additional feature of that aspect of the invention the closure is a zipper having a zipper car and in opening the zipper car moves simultaneously along and across the curved surface.

In still another additional feature of that aspect of the invention the container is a circularly cylindrical bottle having a neck at one end, and a bottom at the other, the cover being formed to conform to the shape of the bottle, wherein the periphery has an ascending portion for extending predominantly along the axis. The periphery has a transverse portion for extending predominantly transverse to the axis and the closure is angled relative to both the ascending portion and the transverse portion.

In still yet another additional feature of that aspect of the invention the ascending portion meets the closure at one apex of the pouch and the transverse portion meets the ascending portion at another apex of the pouch. In yet another additional feature of that aspect of the invention the periphery further comprises another ascending portion, shorter than, and generally opposed to the one ascending portion. In still another additional feature of that aspect of the invention the pouch includes a see-through, flexible external member. In a further additional feature of that aspect of the invention the see-through external member is made of mesh.

In yet a further additional feature of that aspect of the invention, in the instance where the container is a substantially circular cylindrical bottle, with a neck at one end and a bottom at the other, and the cover has a shape to conform to the bottle, the pouch has a see-through flexible external member. The see-through flexible external member is bounded by the periphery and is made of mesh. The periphery is a quadrilateral and, in developed form, has a base for extending circumferentially relative to the bottle. A short ascending portion meets the base at one corner. A long ascending portion meets the base at another corner, the fourth side of the quadrilateral being former by the closure. The closures follow a helical arc when the cover is mounted to the bottle. The long ascending portion includes a pleat for accommodating objects in the pouch preferentially near the long ascending portion.

In another aspect of the invention there is a removable cover for a hand held liquid container of the type having a longitudinal axis, a curved external surface, a bottom, and a spout. There is a cover which has an insulating blanket formed to envelope the canteen. The insulating blanket has a collar for seating about the spout. The cover closure attached to the blanket is operable to capture the liquid container within the cover. There is an insulated end for covering the bottom of the cover. There is a pouch having a periphery mounted to the blanket. The pouch has a closure extending partially in the direction of the longitudinal axis and partially transversely relative thereto.

In an additional feature of that aspect of the invention the cover includes a standoff for maintaining the insulated end clear of a level surface when the container is placed in an upright position relative to the surface. In another additional feature of that aspect of the invention the cover has at least one skirt member extending proud of the insulated end, the one skirt member being arrayed to support the container when the container is placed in an upright position. In still another additional feature of that aspect of the invention the cover includes at least one rim member extending proud of the insulated end, at least one rim member providing support upon which the container can stand. In still yet another additional feature of that aspect of the invention the rim member is a single rim extending about the insulated end. In a further additional feature of that aspect of the invention the rim member includes stiffening.

In still a further additional feature of that aspect of the invention the cover further comprises a grip by which the cover can be held while the pouch closure is being opened. In still yet a further additional feature of that aspect of the invention the grip is located on the cover at a position opposed to the pouch. In an additional feature of that aspect of the invention the grip includes a longitudinally aligned strap. In another additional feature of that aspect of the invention the cover closure terminates at the collar, and is moveable to an open position in which the collar is eased to permit removal of the container therefrom. In yet another additional feature of that aspect of the invention the cover has a circumferential end extending about the insulated end, and the cover closure extends from a first end at the collar to a second end at the circumferential end of the cover.

In still yet another additional feature of that aspect of the invention the insulating blanket has a length greater than the length of the container from the spout to the bottom. The insulating blanket has a drawn in end at the collar and a circular end for location about the insulated end. The cover closure extends longitudinally from the collar to the circular end. The cover closure is moveable to a closed position for drawing opposed edges of the blanket together and to an open position for easing the collar to permit removal of the container. The insulating end is joined about its circumference to the blanket. The insulating end and the insulating blanket are both formed of an inner, reflective layer, an outer layer, and an insulating layer therebetween. The cover includes a stiffened rim extending past the insulated end upon which the container can be supported. The pouch has a first side extending longitudinally from the rim to an end of the pouch closure, and a second side extending along the rim to the cover closure. The pouch closure extends from the cover closure to the first side on a helical arc. The first side has a folded gusset therealong for preferentially accommodating objects in the pouch adjacent thereto. The cover has a handle located thereon in a position circumferentially opposed to the pouch.

In a further aspect of the invention there is a removable cover for a canteen, the canteen having a curved external surface, a bottom, and a neck. The cover comprises an insulating blanket formed to envelope the canteen. The insulating blanket has a collar for seating about the neck of the canteen. The insulating blanket has a closure attached to the blanket, the closure being closeable to capture the canteen within the cover. The insulating blanket has an insulated end for covering the bottom of the canteen. The insulating blanket has a standoff for holding the insulated end clear of a level surface when the canteen is standing in an upright orientation. The insulating blanket has a cover being compliant to permit the canteen to be squeezed while captured therewithin.

In a further aspect of the invention there is a hand holdable insulated container assembly comprising a squeezable container having an outlet. There is an insulating cover for enveloping the container, the insulating cover having a collar for seating about the outlet. The insulating cover is squeezable to permit the container to be squeezed while enveloped within the cover whereby liquid can be urged to exit the container through the outlet while the container remains within the cover.

In an additional feature of that aspect of the invention there is a nozzle for mounting to the outlet. The nozzle is removable to facilitate filling of the container, closeable to retain liquid within the container, and openable to permit liquid to leave the container in a stream when the container and the cover are squeezed.

In yet another additional feature of that aspect of the invention the container has a cylindrical body. The container has a longitudinal axis, a neck at one end thereof terminating in the outlet, and a bottom end at the other end thereof The cover has a cover closure extending from the collar, the closure being moveable to an open position to ease the collar and to permit removal of the container.

In still yet another additional feature of that aspect of the invention the container has a cylindrical body having a longitudinal axis. The container has a neck at one end thereof terminating in the outlet, and a bottom end at the other end thereof. The cover has a standoff located to maintain a clearance between the bottom end of the container and an adjacent surface.

In a further additional feature of that aspect of the invention the container has a cylindrical body having a longitudinal axis. The container has a neck at one end thereof terminating in the outlet and a bottom end at the other end thereof. The cover has a pouch. The pouch has a member having a periphery and a closure for permitting access to the pouch. The closure extends partially in the direction of the longitudinal axis, and partially in a skewed direction relative thereto.

In still a further aspect of the invention there is a bottle assembly comprising a generally cylindrical, squeezable container having a longitudinal axis. The container has an outlet and a nozzle mounted to the outlet. The nozzle is removable to facilitate filling of the container with the liquid, closeable to close the container, and openable to permit a stream of liquid to leave the container. The bottle has a squeezable, removable insulating cover for enveloping the container. The insulating cover has a collar locatable about the outlet. The cover has a standoff maintaining the container clear of a surface, and a cover closure for capturing the container within the cover. The cover closure extends longitudinally relative to the container. The container has a pouch having a closeable boundary, one portion of the boundary extending predominantly along the cover, another portion extending predominantly across the cover, and a pouch closure portion moveable to a closed position to close the boundary, and to an open position to open the boundary and permit objects to be placed within the pouch. The portion has a gusset. The gusset is moveable preferentially to accommodate an object along one edge of the boundary.

In an additional feature of that aspect of the invention the standoff is a circumferential lip for extending longitudinally beyond a closed end of the container. The one portion extends parallel to the longitudinal direction of the cylinder. The other portion extends circumferentially relative to the cylinder. The pouch closure portion extends partially longitudinally and partially circumferentially relative to the container.

The gusset is an inwardly foldable pleat. The cover closure extends longitudinally relative to the container, and one end of the cover closure meets the collar. The cover closure is moveable to an open position in which the collar is open to release the container. The container outlet has a neck, and the collar is sized to seat about the neck. The container is made of an insulating blanket, the insulating blanket comprising an outer layer, a filling, and a reflective inner layer. The lip has a stiffener captured therein. The cover has a bicycle mount fastened thereto. The pouch has an external pouch closure panel. The panel is at least partially transparent. The panel is an open mesh. The pouch is at least three sided. The pouch is generally four sided. Two of the sides are extending longitudinally relative to the container. One of the longitudinally extending sides is longer than the other of the longitudinally extending sides, whereby in developed form the pouch is trapezoidal. The pouch has a hand grip. The hand grip is mounted on the cover remote from the pouch. The handgrip extends longitudinally relative to the container. The container is squeezable while in the cover, to permit a stream of liquid to leave the container and be squirted into a user's mouth remote from the container. The water permeable side permits transpiration of water captured therein, whereby drying of the cover can contribute a cooling effect to the container.

DETAILED DESCRIPTION OF THE INVENTION

Figure 1:
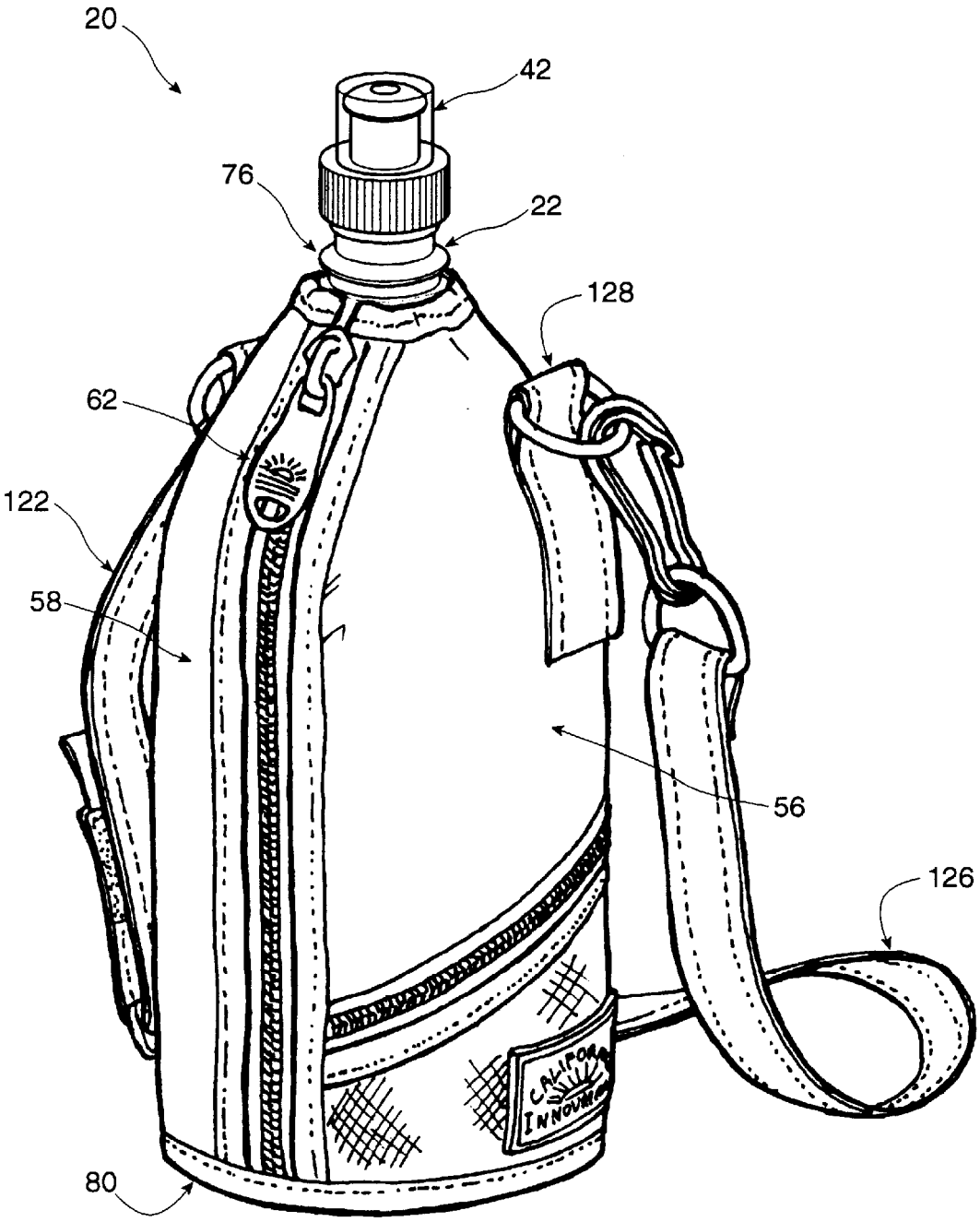
FIG. 1 is a general arrangement, three quarter view of an example of a container in a cover according to the principles of the present invention.

The description which follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

Figure 2:
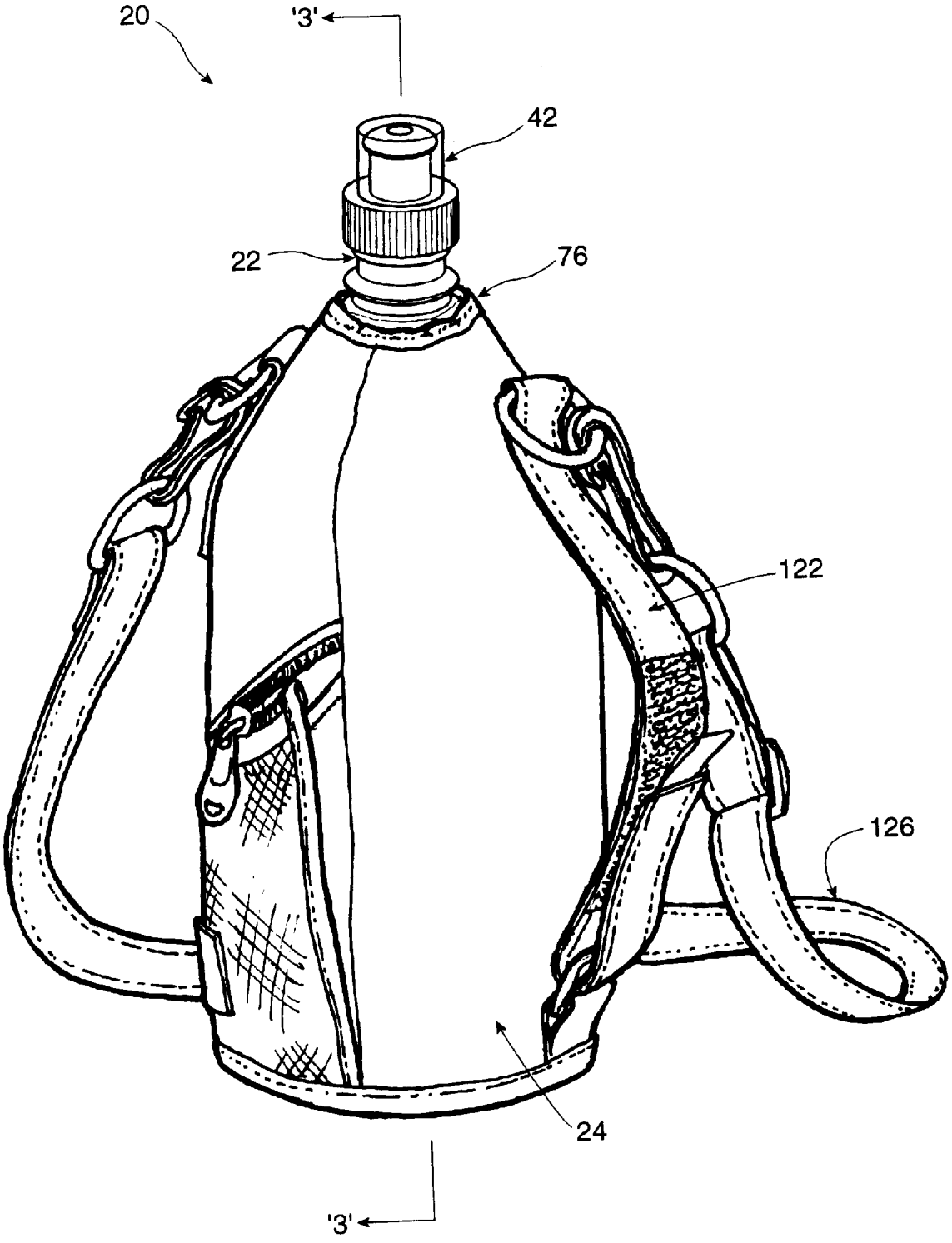
FIG. 2 is a view of the example of FIG. 1 taken from a position on the opposite side of the container from the view shown in FIG. 1.
Figure 3:
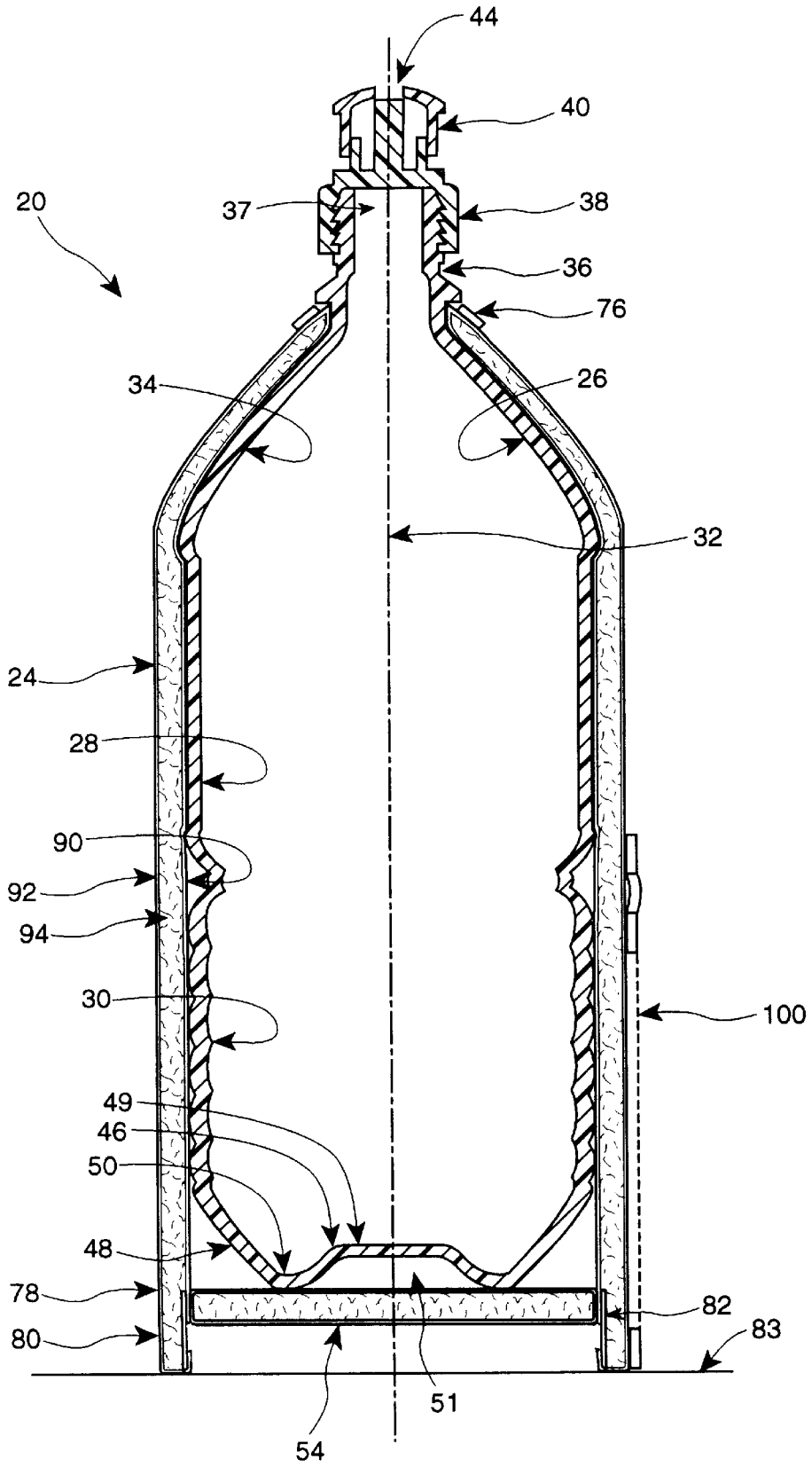
FIG. 3 is a sectional view of the container and cover of FIG. 1 taken on diametral section '3—3'.
Figure 4:
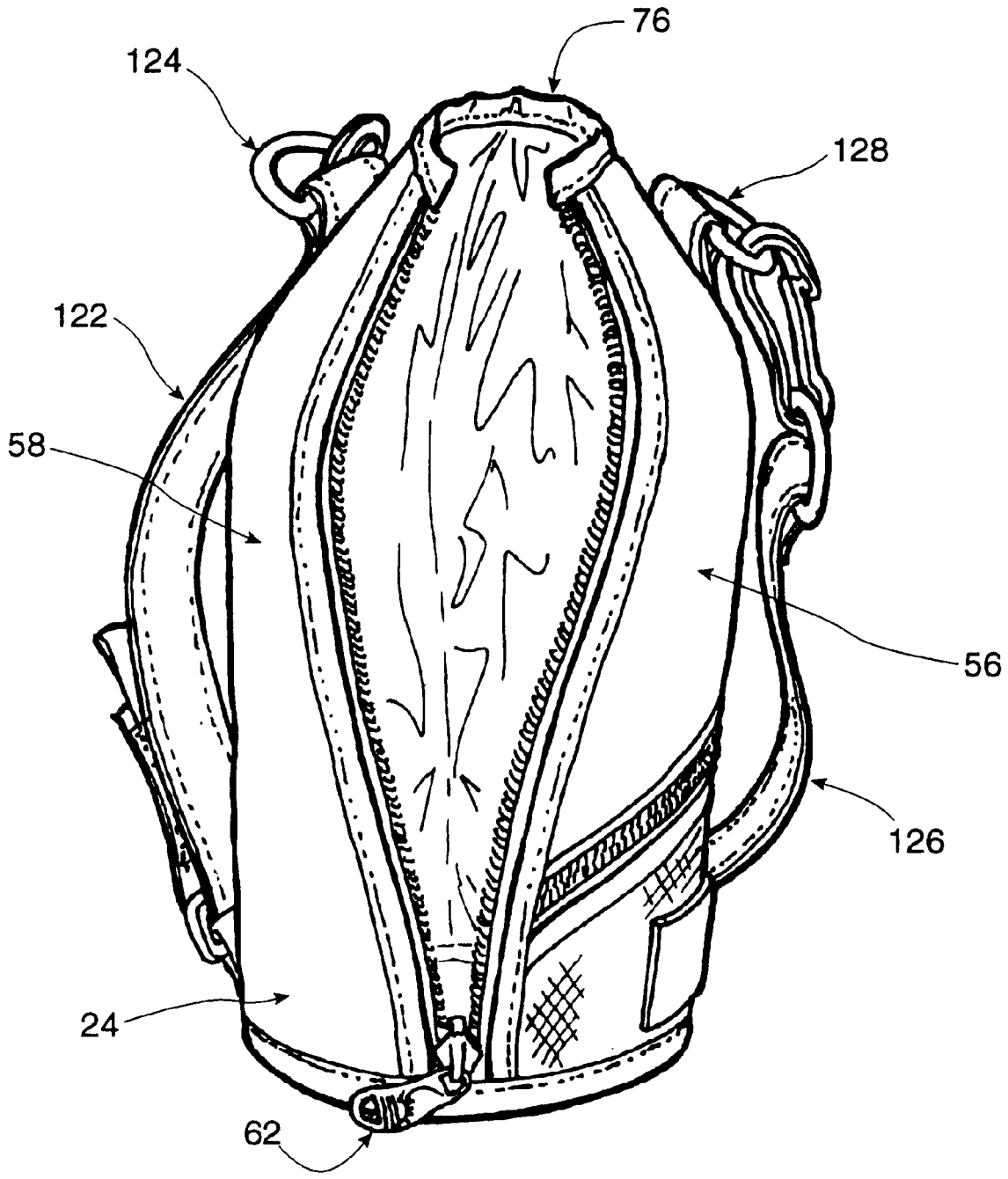
FIG. 4 is a view of the cover of FIG. 1 with the container removed.

A container assembly is shown generally in FIGS. 1, 2 and 3 as 20. It has a squeezable container 22 and an insulated cover 24. Container 22 has the form of a bottle 26 whose major portion 28 is that of a right cylinder with ribs 30 such as may improve a grip. Bottle 26 has a longitudinal axis 32 that is coincident with the centerline of the round cylindrical section of major portion 28. At one end of bottle 26 there is a transition section 34 from the broad profile of major portion 28 to an externally threaded spout or neck 36 which terminates in an outlet. An internally threaded nozzle 38 mates with neck 36 and controls the flow of liquid out of container 22 through the outlet 37 of neck 36. Nozzle 38 has a longitudinally translating cap 40 which can be moved to a closed position, in which cap 40 seals nozzle 38, and to an open position, in which a stream of water can escape through an end aperture 44. A transparent snap-fit dust cover 42 can be provided. Container 22 is soft enough to be squeezed with one hand. Adequately forceful squeezing, with container 22 oriented to place liquid against nozzle 38, will cause a stream to exit container 22, such that a person can squirt, for example, cool water into their mouth without touching the container other than with the squeezing hand. At the other, opposed, end of bottle 26 there is a bottom end 46 having a taper, or chamfer 48, and an end face 49 that has an annular footing 50 and a relieved center 51.

Referring to FIGS. 3, 4, 5 and 6, insulated cover 24 has an insulation blanket structure that is made up of a two part main blanket 52 and end cap, or end face panel 54. Main blanket 52 has a first half shell 56 and a second half shell 58. Half shells 56 and 58 are similar in construction. They are joined at a mutual seam 60 along one longitudinal meridian, and by a longitudinal closure, in the nature of a zipper 62, along a diametrally opposed longitudinal meridian. At one end, nominally the upper end for the purposes of this description, each half shell has a tuck, or dart, 64, and a pair of edge reliefs 66 and 68 of similar profile to the sides of dart 64. The tapering portions 70 and 72 so created at the ends of half shells 56 and 58 each terminate at their distal extremities in an arcuate cusp 74. When darts 64 and reliefs 66 and 68 are sewn up, tapering portions 70 and 72 draw in together to approximate the profile of transition section 34, with cusps 74 seamed together to form a collar 76 for seating snugly about the base of the flange of spout, or neck 36. The unseamed, free edges of half shells 56 and 58 each receive one set of teeth of zipper 62.

In the assembled configuration, cover 24 extends from collar 76 to a base end 78. End face panel 54 is a circular disc of insulating material having its circumference joined by sewing inside the substantially circular cylindrical profile of base end 78. Base end 78 has a skirt, or rim 80, that extends continuously circumferentially about end face panel 54. Rim 80 stands longitudinally proud of end face 54. Rim 80 has stiffening, in the nature of a plastic annular strip 82 sewn on its inside face. Assembly 20 can be set on rim 80 in a substantially upright position on a resting surface 83. For the purposes of this description upright means that longitudinal axis 32 is substantially vertical, and the rim of skirt 80 is substantially perpendicular to longitudinal axis 32. In this position rim 80 acts as a standoff for maintaining end face panel 54, and hence bottom end 46, clear of the adjacent resting surface 83.

As noted, zipper 62 extends from collar 76 to rim 80. When the zipper car is advanced upward along the teeth it causes collar 76 to tighten about neck 36. Conversely, when zipper 62 is undone it eases collar 76 and thereby permits container 22 to be removed. This permits a user to wash cover 24, or to clean or fill container 22 without getting cover 24 wet. This also permits container 22 to be filled with a liquid. When container 22 is uninsulated its contents are more easily chilled in the refrigerator or freezer. When the contents have been chilled or frozen (or heated somewhat, if so desired) container 22 can be placed inside insulating cover 24. It also allows container 22 to be filled with warm beverages, for any drips to be wiped off, dried, and then placed in cover 24.

A section through either half shells 56 and 58 or end face panel 54 includes a substantially impermeable reflective layer inner layer 90, a reinforced, tear resistant woven nylon outer layer 92, and a foam insulation layer 94 trapped between the two.

Figure 5:
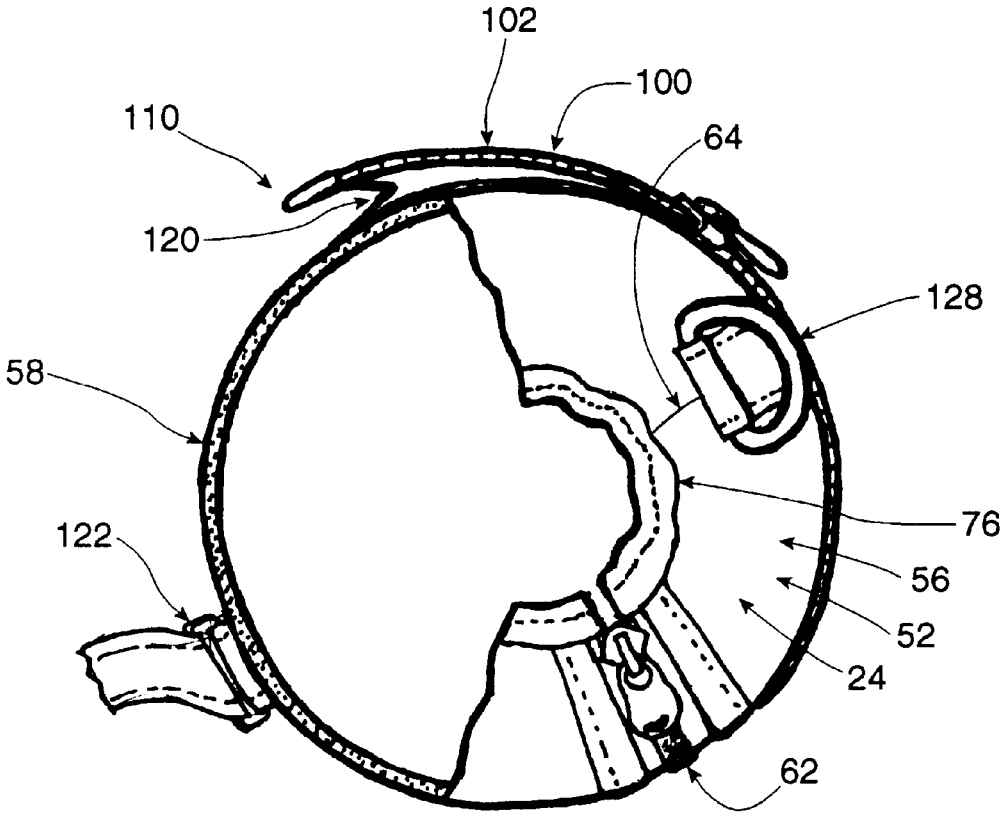
FIG. 5 is a developed view of the cover of FIG. 4.
Figure 6:
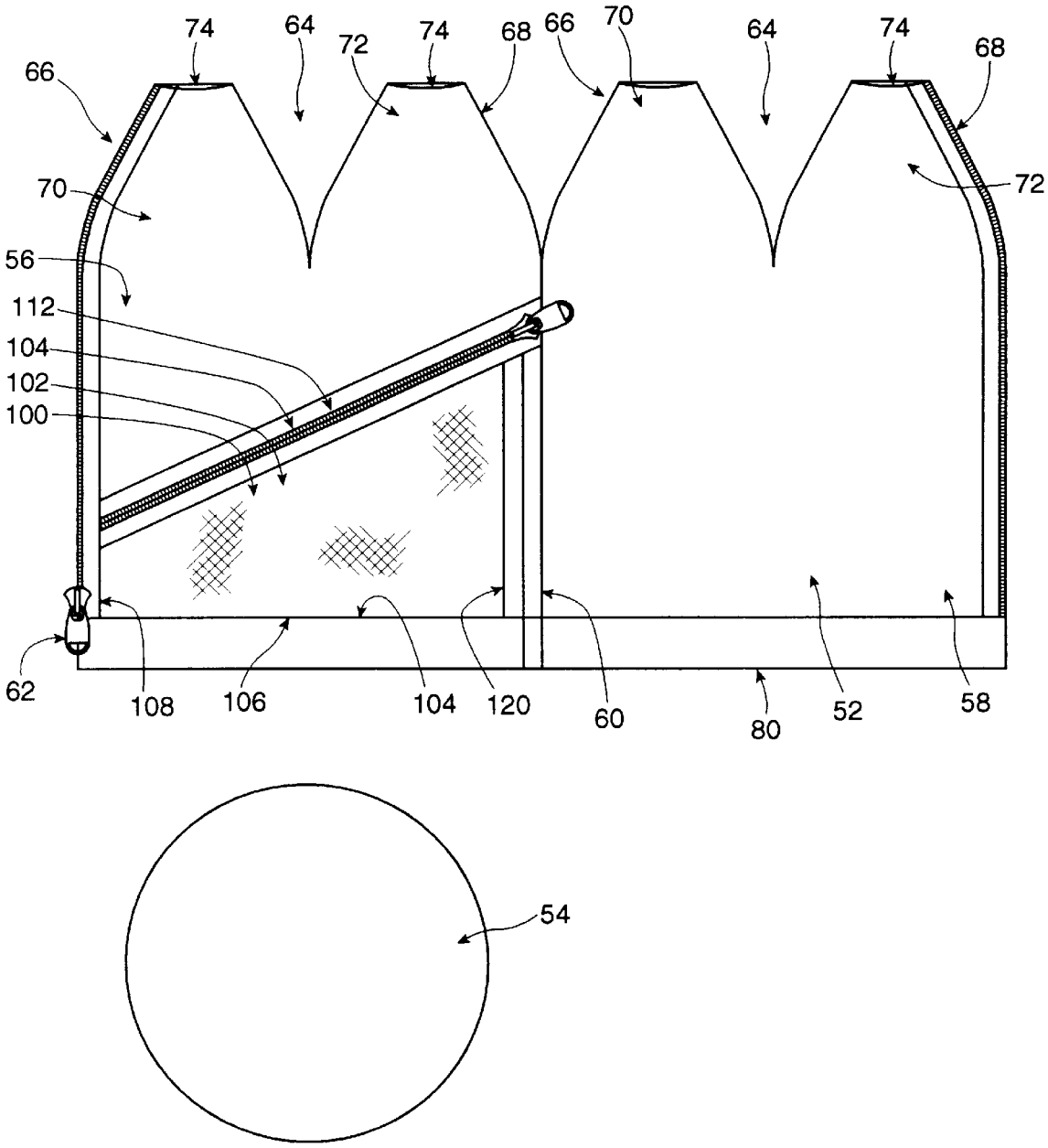
FIG. 6 is a top view of the cover of FIG. 3 taken in partial cross-section with a set of car keys shown in a pouch of the cover.

An externally accessible pouch 100 is formed on the outside of half shell 56. It has a flexible external panel 102 of mesh, that has a boundary 104 defining the limits of pouch 100. The mesh of panel 102 is see-through mesh, conveniently permitting the contents of pouch 100 to be examined without the necessity of removal. Pouch 100 has a base side, or base edge 106 that runs transverse to axis 36 about an arc of the circumference of rim 80. A first, minor or shorter, ascending edge 108 is attached to zipper 62 and meets base edge 106 at a comer and extends longitudinally therefrom. A second, major ascending edge 110 runs parallel to ascending edge 108, and is spaced therefrom by an arc of the circumference of assembly 20 to form a comer with base edge 106 such that it is not only opposed, but nearly diametrically opposed to edge 108. A pouch closure, in the nature of a pouch closure zipper, 112, runs between the neckward ends of edges 108 and 110 and acts as a guide to maintaining the edge of pouch 100 next to cover 24 as cover 24 follows the curved surface of bottle 26. The resultant four sided shape, when laid flat, constitutes a trapezoid. When pouch closure zipper 112 is closed (that is, when the zipper car is run fully toward its junction with major ascending edge 110) there will be a tendency for external panel 102 to be drawn tight against the form of the external surface of cover 24. Pouch 100 is provided with an expandable portion in the nature of an inwardly folding gusset 120, that folds flat when there is nothing contained in pouch 100. When an object is placed in pouch 100 that will not lie flat against the surface contour of cover 24 such as a set of keys as illustrated in FIG. 5, then gusset 120 will unfold, either partially or fully, to accommodate that object. Since gusset 120 lies along edge 110, objects placed in pouch 100 will be preferentially accommodated where there is the most room, that is, adjacent to gusset 120, and hence edge 110.

A grip or handle in the nature of an adjustable strap 122 is mounted to cover 24 at a location generally in opposition to pouch 100. Specifically, it is mounted to lie parallel to a longitudinal meridian of cover 24 diametrically opposed to a position that falls within the arc of the circumference of cover 22 that is covered by pouch 100. Strap 122 terminates at an end loop having a keeper 124 that can serve as an independent fastening point, or, as shown, provides a connection for two ends of a detachable, adjustable shoulder strap 126. A second, sewn loop and keeper 128 is mounted on the opposite side of cover 24, relatively close to collar 76. The combined use of keepers 124 and 128 permits assembly 20 to be suspended in a manner discouraging twisting or spinning. Use of keeper 128 by itself tends to cause assembly 20 to hang in an attitude with pouch 100 facing upward, and pouch closure zipper 112 uppermost, such that even if zipper 112 is not fully closed, objects will be discouraged by gravity from falling out of pouch 100.

In use, a person can hold assembly 20 with the fingers of one hand inserted between strap 122 and cover 24, without necessarily closing the thumb on the other side of cover 24. Further when held in this way, if the tab of the zipper car of pouch closure zipper 112 is held between the thumb and forefinger of the other hand, a rolling motion of the wrist of the first hand will result in either opening or closure of pouch 100. The combined motion across and along the curved surface of cover 24 has been found comfortable. In the preferred embodiment the angle of inclination of the helical arc of zipper 112, in the developed view, gives roughly a 3 inch rise over a 5 ¾" run, or roughly 25 to 30 degrees of angular inclination.

Further, a person grasping assembly 20 can squeeze cover 24, simultaneously squeezing container 22 nested inside cover 24, to produce a stream of liquid exiting container 22, assuming outlet nozzle 38 to be open. The mouth of the user need not touch nozzle 38, or any other part of assembly 20.

Other arrangements are possible in which the bottle is not a body of revolution, and in which the longitudinal axis is not an axis of symmetry of the container. In general however, the longitudinal axis is oriented perpendicularly to a resting surface when the container assembly is left sitting on end.

Container 22 has a round cylindrical section. The section need not be circular, but could be oval, elliptical, square, rectangular, kidney shaped, or some other polygonal or curved shape suitable for containing a liquid, subject to the difficulties of manufacturing a cover to envelope the resulting form. Container 22 need not have an axis of symmetry, and need not have a spout having a centreline perpendicular to the base on which the container sits in an upright orientation. The spout, or neck, 36, need not be concentric with the cylindrical form of the container generally, but could be offset to one side, and could be bent, or mitred, or canted. Other types of spout or nozzle than that shown can be used.

Rim 80 need not be continuous, and could include a number of discrete tips, or castellations, or skirts extending over only partial arcs to yield an adequate standoff configuration. Many arrangements are possible provided that the resulting configuration has a sufficient distribution about the periphery of assembly 20 to give stability. Standoffs can be mounted, for example, directly to end face panel 54.

Cover closure zipper 62 need not extend for the full length from collar 76 to rim 80, but could extend only part way, sufficient to permit easing of collar 76 to release container 22. Further, zipper 62 need not run along a meridian of cover 24, but could run on an arc, or at a skewed angle to axis 36.

A pouch can be formed by a panel having a periphery, or a boundary, that covers some area of cover 24. It need not have straight sides. When laid flat, as in the developed view of FIG. 6, some, or all of the portions of the boundary of the pouch could be arcuate. Some or all of the portions of the boundary could be formed with straight edges. Although a trapezoidal pocket shape is shown, a triangular shape could be used, or some other suitable shape. Edges 106 and 108 need not run along longitudinal meridians of cover 24, but could be skewed to it. Similarly, closure 112 could be arcuate in developed plan view, and could be placed at a different angle relative to base edge 106 or edges 108 or 110. In the embodiment shown, closure 112 extends at an angle that is skewed relative to axis 36 such that, as assembled, it follows a helical arc. A pouch can be made in which pouch closure zipper 112 does not form a boundary edge, but rather lies in an intermediate location in panel 102. Use of closure zipper 112 as a boundary edge is relatively easy and convenient.

Types of pouch closures other than zippers can be used. A deformable seal, whether continuous or discontinuous could be used, as could multiple hook and eye fabric fastener tapes, snaps, buttons, grommets or other means for controlling the access to the contents of the pouch.

A pocket can be made with no angular inclination of the zipper. That is, the zipper can run circumferentially about the bottle perpendicular to axis 32 or it could run parallel to axis 32. However, an angled closure is preferred. The angular inclination of zipper 112, in the developed view, could be such as to give a greater or lesser vertical rise than 3 inches over the given run. For example, it could be a small rise, such as half an inch, or as great as roughly 7 inches for the 1 Litre bottle illustrated. A moderate range of such rises is in the range of 2 inches to 4 inches. Similarly, when taken as an angle, the range could be other than from 25 to 30 degrees. It could, for example, range from a very shallow angle, of perhaps 5 degrees, to a very steep angle, of 70 degrees (on a shorter circumferential run). As noted parenthetically, the run shown is just less than half the circumference of cover 24. It could be either greater or smaller than this amount. A quite steep closure angle, or large rise over a given run, would suggest a relatively shorter run, as the cover does not have infinite length. Closure angles in the range of 15 to 45 degrees are desirable.

Flexible panel 102 could be made of a stretchable elastic material. gusset 120 could be formed of mesh or an elastic material, or a hinged stiff material.

A preferred embodiment has been described in detail and a number of alternatives have been considered. As changes in or additions to the above described embodiments may be made without departing from the nature, spirit or scope of the invention, the invention is not to be limited by or to those details, but only by the appended claims or their equivalents.

I claim:

1. A pouch adapted to be mounted to a cover of a hand held liquid in the nature of a bottle having a curved bottle surface, a longitudinal axis, a net and a bottom, the longitudinal axis having a direction and the cover having a curved surface formed to conform to the shape of the bottle, said pouch comprising;

a flexible panel having a periphery mountable to the cover; and a pouch closure mounted to said flexible panel to control access to said pouch, said periphery having an ascending portion locatable on said cover to extend predominantly in the direction of said longitudinal axis;

said periphery having a transverse portion locatable on said cover to extend predominantly transversely relative to said longitudinal axis;

said pouch closure having a first end adjacent said ascending member and a second end distant therefrom, and one of said first and second ends of said closure lies more distantly than the other from said transverse portion.

2. A pouch as claimed in claim 1 wherein said pouch closure extends in a direction having a component parallel to said axis and another component skewed relative to said axis.

3. The pouch of claim 2 wherein said closure is inclined relative to said longitudinal axis.

4. The pouch of claim 1 wherein said pouch closure includes a guide mounted to said flexible panel such that, in use, said guide follows the curved surface of the cover.

5. The pouch of claim 1 wherein said flexible panel includes an expandable portion adjacent to said closure.

6. The pouch of claim 5 wherein said expandable portion includes a foldable member.

7. The pouch of claim 6 wherein said expandable portion is located along said ascending portion of said periphery of said flexible panel, in use said ascending portion running parallel to said longitudinal axis, said foldable member being a pleated gusset.

8. The pouch of claim 1 wherein, in use, said pouch closure follows a helical arc relative to said longitudinal axis.

9. The pouch of claim 1 wherein said pouch closure is mounted to said flexible panel along a portion of said periphery.

10. The pouch of claim 1 pouch closure is a zipper having a zipper car, and, in opening, said zipper car moves in a direction having components both along and across said curved surface of said cover relative to said axis.

11. The pouch of claim 1 wherein said ascending portion meets said closure to define a first vertex of said pouch; and said transverse portion meets said ascending portion to define a second vertex of said pouch.

12. The pouch of claim 11 wherein said ascending portion is a first ascending portion, and said periphery of said flexible panel has a second ascending portion, longer than, and generally opposed to, said first ascending portion.

13. The pouch of claim 1 wherein said flexible panel includes a see-through member.

14. A pouch adapted to be mounted to a cover for a container in the nature of a substantially circular cylindrical bottle with a neck at one end and a bottom at the other, the cover having a shape to conform to the bottle, and wherein:

said pouch has a flexible member, said flexible member having a periphery;

said periphery, in developed form, has the shape of a quadrilateral having a first side in the nature of a base attachable to the cover to extend circumferentially, in use, relative to the bottle, a second side in the nature of a short ascending portion, meeting said base to define one corner of said quadrilateral, a third side in the nature of a long ascending portion meeting said base to define another corner of said quadrilateral, and a fourth side extending between said long and short ascending portions to define remaining corners of said quadrilateral;

said pouch having a pouch closure formed along said fourth side of said quadrilateral;

said pouch closure following a helical arc when the cover is mounted to the bottle; and said long ascending portion includes a pleat for accommodating objects in said pouch preferentially near said long ascending portion.

15. A removable cover adapted for use with a hand held liquid container, the container having a longitudinal axis, a curved external surface, a bottom, and a spout, said cover; comprising:

an insulating blanket formed to envelope the container;

said insulating blanket having a collar for seating about the spout;

an insulated end panel for covering the bottom of the container, said insulated end panel being attached to said blanket to form a bottom end of said cover;

a cover closure attached to said blanket, and cover closure being operable to capture the liquid container within said cover; and a pouch having a flexible panel and a pouch closure mounted thereto, said flexible panel having a periphery mounted to said blanket, said pouch closure extending partially in the direction of the longitudinal axis and partially transversely relative thereto, said pouch closure having a first end and a second end, one of said first and second ends lying more distantly from said insulated end covering than the other.

16. The cover of claim 15 wherein said cover includes a standoff for maintaining said insulated end clear of a level surface when the container is placed in an upright position relative to the surface.

17. The cover of claim 15 wherein said cover has at least one skirt member extending proud of said insulated end, said at least one skirt member being arrayed to support the container when the container is placed in an upright position.

18. The cover of claim 15 wherein said cover includes at least one rim member extending proud of said insulated end, said at least one rim member providing support upon which the container can stand.

19. The cover of claim 15 wherein said cover further comprises a grip by which said cover can be held while said pouch closure is being opened.

20. The cover of claim 15 wherein said cover closure terminates at said collar, and is moveable to an open position in which said collar is eased to permit removal of said container therefrom.

21. The cover of claim 20 wherein said cover has a circumferential end extending about said insulated end, and said cover closure extends from a first end at said collar to a second end at said circumferential end of said cover.

22. The cover of claim 15 wherein:

said insulating blanket has a drawn-in end at said collar and a circular end for location about, and attachment to, said insulated end panel;

said cover closure extends longitudinally from said collar to said circular end, is movable to a closed position for drawing opposed edges of said blanket together and to an open position for easing said collar to permit removal of the container;

said insulating end is circular in plan view, has circular circumference, and is joined about said circumference to said blanket;

said insulating end panel and said insulating blanket are both formed of an inner, reflective layer, an outer layer, and an insulating layer therebetween;

said pouch has a first side extending longitudinally away from said circulated end of said blanket to an end of said pouch closure, and a second side extending along said circular end of said blanket from said first side to said cover closure, said first and second sides meeting to define a corner of said pouch;

said pouch closure extends from said cover to said first side on a helical arc;

said first side has a folded gusset there along for preferentially accommodating objects in said pouch adjacent thereto; and said cover has a handle located thereon in a position circumferentially opposed to said pouch.

23. The cover of claim 15 wherein said cover is a removable cover for a canteen having a curved external surface, a bottom, and a neck, said cover comprising;

a standoff for holding said insulated end clear of a level surface when said canteen is standing in an upright orientation; and said cover being compliant to permit the canteen to be squeezed while capture therewithin.

* * * * *